United States Patent [19]

Bulman

[11] Patent Number: 4,967,638

[45] Date of Patent: Nov. 6, 1990

[54] LIQUID PROPELLANT WEAPON SYSTEM

[75] Inventor: Melvin J. Bulman, Shelburne, Vt.

[73] Assignee: General Electric Company, Burlington, Vt.

[21] Appl. No.: 263,792

[22] Filed: May 14, 1981

[51] Int. Cl.[5] ..... F41F 1/04

[52] U.S. Cl. ..... 89/7; 89/9

[58] Field of Search ..... 89/7, 9, 11, 1 R

[56] References Cited

U.S. PATENT DOCUMENTS

| | | | |
|---|---|---|---|
| 3,366,058 | 1/1968 | Scanlon | 89/7 |
| 3,576,103 | 4/1971 | Kahn | 89/7 X |
| 3,763,739 | 10/1973 | Tassie | 89/7 |
| 3,783,737 | 1/1974 | Ashley | 89/7 |
| 4,023,463 | 5/1977 | Tassie | 89/7 |
| 4,050,352 | 9/1977 | Tassie | 89/7 |
| 4,051,762 | 10/1977 | Ashley | 89/7 |
| 4,099,445 | 7/1978 | Singelmann et al. | 89/7 |
| 4,100,836 | 7/1978 | Hofmann | 89/7 |
| 4,215,620 | 8/1980 | Tassie | 89/7 X |
| 4,231,282 | 11/1980 | Ashley | 89/7 |
| 4,244,270 | 1/1981 | Tassie | 89/33 C |

*Primary Examiner*—David H. Brown

*Attorney, Agent, or Firm*—Bailin L. Kuch

[57] ABSTRACT

A feature of this invention is the provision of an ignition mechanism for a main combustion chamber including an ignition antechamber having a first cross-sectional area, an electrode, and an inlet port for liquid propellant; a conduit having a length over diameter ratio greater than one, a second cross-sectional area which is less than said first area, and an inlet which opens into said ignition antechamber and an outlet which opens through an orifice into said main combustion chamber.

6 Claims, 2 Drawing Sheets

LIQUID PROPELLANT WEAPON SYSTEM

BACKGROUND OF THE INVENTION

1. Field of the Invention

This invention relates to weapon systems employing a liquid propellant, and particularly to an ignition mechanism for such systems.

2. Prior Art

Liquid propellant guns are well known, and are shown, for example, in U.S. Pat. No. 4,023,463 issued to D. P. Tassie on May 17, 1977; U.S. Pat. No. 4,051,762 issued to E. Ashley on Oct. 4, 1977: and in U.S. Ser. No. 178,254 filed by M. Bulman on Aug. 7, 1980.

Such guns, firing non-hypergolic propellants, require an initial pulse of hot, high pressure gas in the combustion chamber to start the firing process for each shot. For repetitive firing, sequential pulses must be provided. When pyrotechnic primers are utilized, the expended primer must be replaced after each shot as shown in U.S. Pat. No. 4,051,762, supra. Alternatively, some monopropellants may be ignited by adiabatic compression as shown in U.S. Pat. No. 3,366,058 issued to J. J. Scanlon on Jan. 30, 1968, U.S. Pat. No. 3,576,103 issued to P. B. Kahn on Apr. 27, 1971, and U.S. Pat. No. 4,231,282 issued to E. Ashley on Nov. 4, 1980. Even when an electric arc is utilized for ignition, the propellant must be confined and exposed to sufficient temperature and pressure for combustion of the entire charge to occur. Such a situation is more easily achieved in a bulk loaded system where the combustion chamber is completely filled with propellant. In a regenerative piston system, the combustion chamber is relatively empty of propellant at the time of ignition.

An object of this invention is to provide an electrical mechanism for the ignition of liquid propellants particularly adapted for use in regenerative piston systems.

A feature of this invention is the provision of an ignition mechanism for a main combustion chamber including an ignition antechamber having a first cross-sectional area, an electrode, and an inlet port for liquid propellant; a conduit having a length over diameter ratio greater than one, a second cross-sectional area which is less than said first area, and an inlet which opens into said ignition antechamber and an outlet which opens through an orifice into said main combustion chamber.

BRIEF DESCRIPTION OF THE DRAWING

These and other objects, features and advantages of the invention will be apparent from the following specification thereof taken in conjunction with the accompanying drawing in which.

DESCRIPTION OF THE INVENTION

Figure 1:
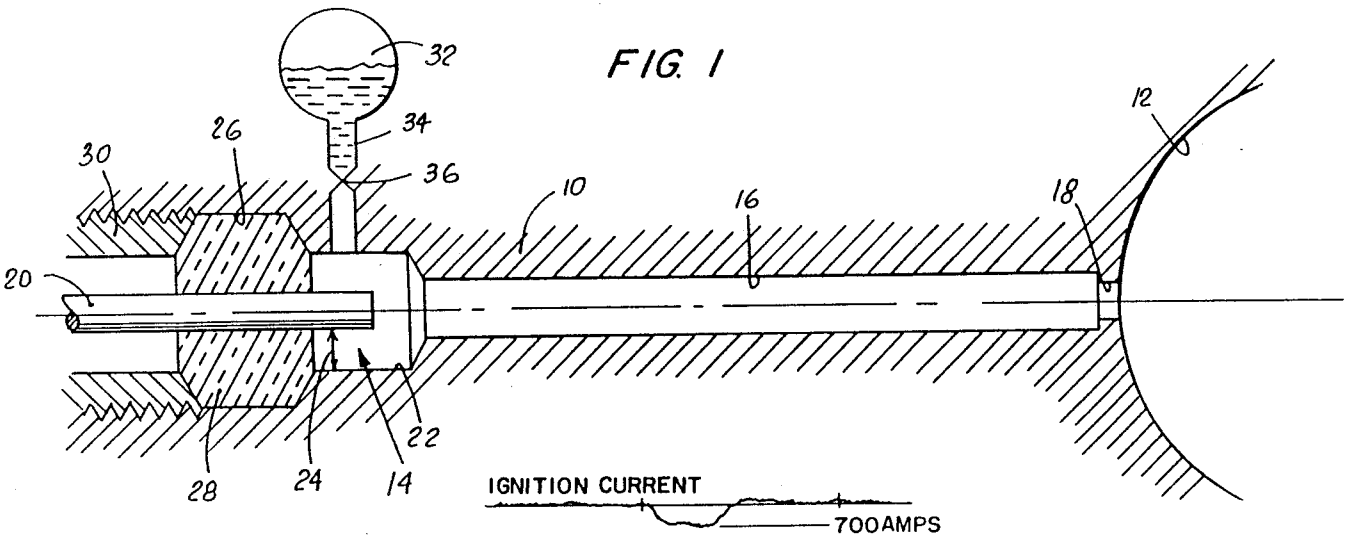
FIG. 1 is a view in cross section of an ignition mechanism embodying this invention.

FIG. 1 shows the basic ignition system embodying this invention. It provides a confinement of the ignition and booster charge during the ignition stage of the gun cycle.

The system includes a housing 10 having a main combustion chamber 12, an ignition antechamber 14, and a conduit 16 communicating with and between these two chambers. The cross-sectional area of the conduit is smaller than the cross-sectional area of each of the chambers. The opening of the conduit 16 into the main chamber 12 is restricted by an orifice 18. The length over diameter ratio of the conduit 16 is greater than one. The length and the diameter of the conduit 16 should be selected as a function of the desired characteristics ignition performance, e.g., total energy delivered to the main combustion chamber, peak pressure in main combustion chamber, repetition rate, etc. An electrode 20 projects into the ignition antechamber and is spaced from the conductive sidewall 22 of this chamber by an annular gap 24. The sidewall serves as a second electrode. The electrode 20 is fixed and sealed in a bore 26 in the housing by a rigid dielectric bead 28 which is secured by a threaded tubular element 30. Alternatively, the electrode assembly may be built up as shown in U.S. Pat. No. 4,215,620 issued to D. P. Tassie on Aug. 5, 1980, hereby incorporated by reference. A source 32 of liquid propellant under pressure is coupled via a conduit 34 and a valve 36 to the ignition antechamber. The valve 36 and the electrical source (not shown) to the electrodes are synchronously controlled during each gun cycle by a drum cam as shown in U.S. Pat. No. 3,763,739 issued to D. P. Tassie on Oct. 9, 1973, hereby incorporated by reference.

In operation, the valve 36 is initially opened to admit liquid propellant under pressure into, and to fill, the ignition antechamber 14 and the conduit 16, driving any ullage air and residue combustion gas out therefrom into the main combustion chamber. Thereafter the valve 36 is closed and the electrical source, which is conventionally a charged capacitor, is coupled to and discharged across the electrodes 20 and 22. This ignition current passes through the liquid propellant in the ignition antechamber. The current generates heat which decomposes some of the propellant. The decomposition generates gas which attempts to expand into the conduit but which is resisted by the liquid propellant which is at rest in the conduit and acts as an inertial column or plug. This inertial column contains the liquid propellant in the antechamber and permits the development in the antechamber of adequate gas pressure for the initiation of combustion of the liquid propellant and the propagation of this combustion. The gas-liquid interface progresses through the antechamber and into the conduit 16. The liquid propellant in the conduit is progressively accelerated under the pressure of the combustion gas and discharged into the main combustion chamber. In due course the liquid propellant which is discharged is itself actively undergoing combustion and serves as a booster to ignite the liquid propellant in the main combustion chamber.

Figure 2:
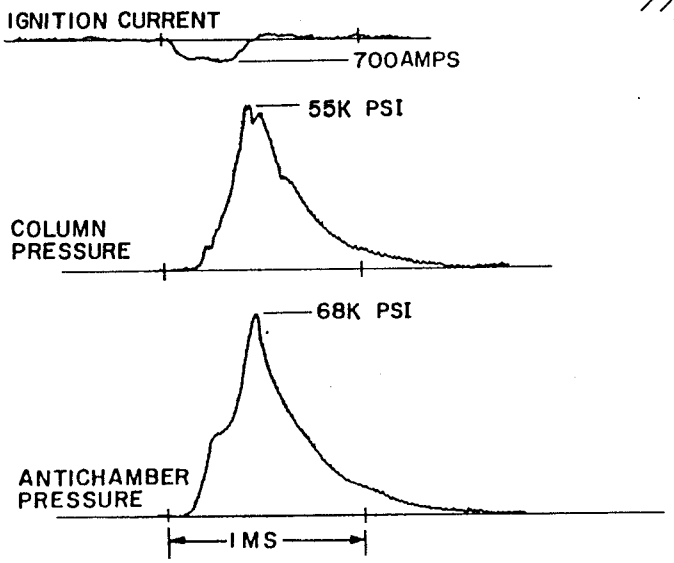
FIG. 2 is a chart showing ignition current, column pressure and ignition antechamber pressure, all as a function of time, in an exemplary embodiment of FIG. 1.

In an exemplary system, the conduit 16 has a diameter of 0.125" and length of 1.885" and the orifice has a diameter of 0.125". The antechamber 14 has a diameter of 0.25" and an electrode gap 24 of 0.094". FIG. 2 shows the function of this exemplary system over a time interval of particular interest of one millisecond. It will be seen that the current flow between the electrodes is 700 amperes which generates a peak pressure of 68,000 psi in the ignition antechamber 14 and a peak pressure of 55,000 psi in the conduit 16.

Figure 3:
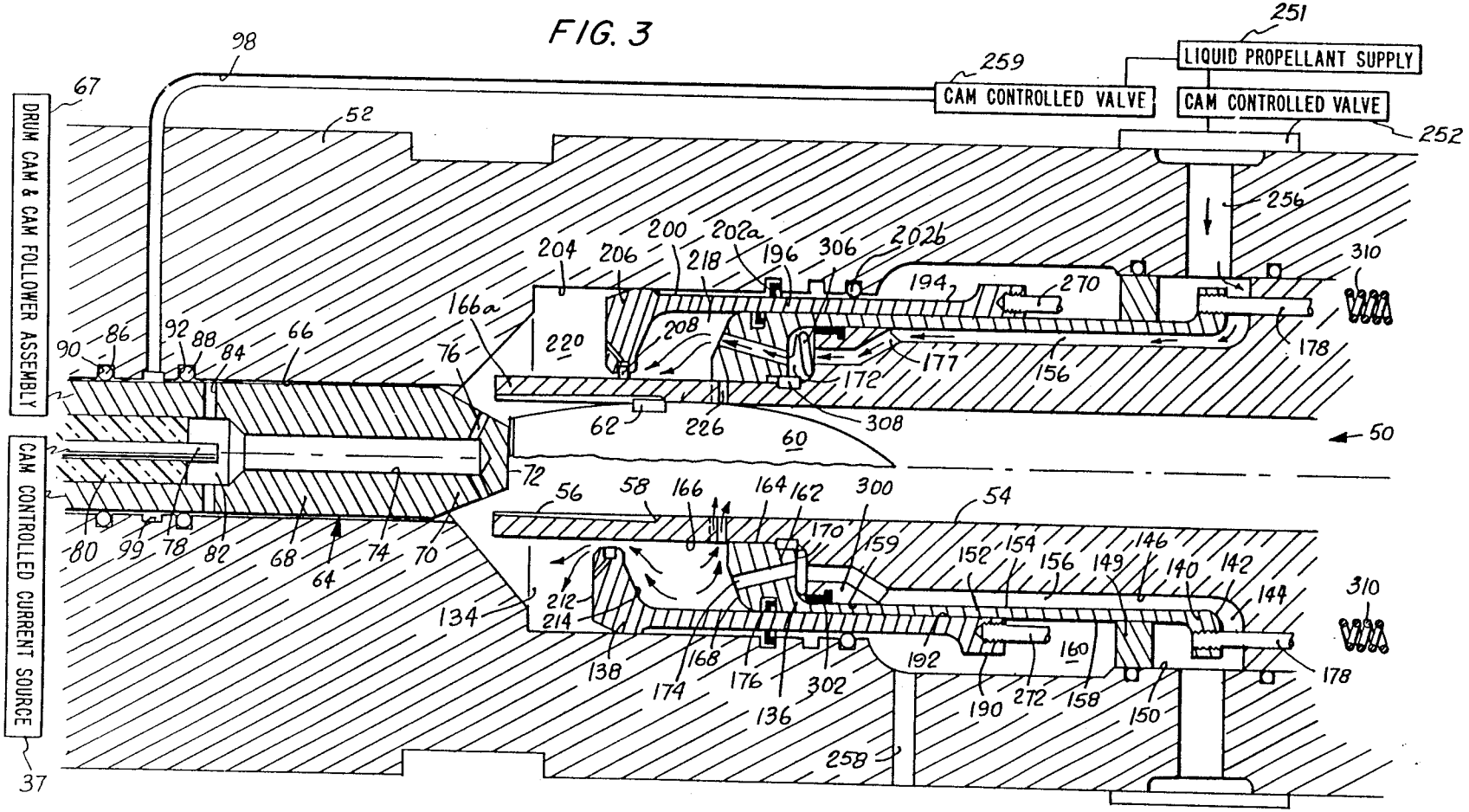
FIG. 3 is a view in cross section of an ignition mechanism embodying this invention incorporated in a liquid propellant, regenerative piston gun.

FIG. 3 shows a modification of the mechanism of FIG. 1 incorporated in a liquid propellant, differential piston gun of the type shown by M. Bulman in Ser. No. 178,254, supra.

The gun system includes a gun barrel assembly 50 which is fixed within a housing 52. The barrel assembly has a rifled firing bore 54, a projectile receiving chamber 56 and an intermediate forcing cone 58. A projectile 60 with a band 62 is chambered, and locked by a bolt 64 disposed in a longitudinal bore 66 in the housing which is coaxial with the bore 54, and which bolt is controlled by a drum cam and cam follower assembly 67.

The bolt 64 includes a bolt body 68 having a truncated conical forward portion 70 with a bolt face 72 and a longitudinal blind bore 74 which terminates aft of the bolt face 72. A plurality of radial bores 76 communicate between the forward end of the bore and the exterior of the conical surface. An electrode 78 is fixed in the aft end of the bore by a dielectric tube 80 and has a forward portion extending into an enlarged portion 82 of the bore. A plurality of radial conduits 84 extend from the bore enlargement 82 to the exterior of the bolt body. The bolt body 68 slides and is sealed within two annular seals 86, 88 which are fixed respectively in two annular grooves 90, 92 in the bore 66. A conduit 98 through the housing 52 leads from a pressurized source of liquid propellant, to an annular groove 99 in the longitudinal bore 66. The bolt is reciprocated in the bore 66 by a drum cam as shown in U.S. Pat. No. 3,763,739 issued to D. P. Tassie on Oct. 9, 1973 and U.S. Pat. No. 4,244,270 issued to D. P. Tassie on Jan. 13, 1981, and hereby incorporated by reference. The annular seal 88 may be of the type shown in U.S. Pat. No. 3,783,737 issued to E. Ashley on Jan. 8, 1974, or of the type shown in U.S. Pat. No. 4,050,352 issued to D. P. Tassie on Sept. 27, 1977. The drum cam reciprocates the gun bolt between an aftmost disposition whereat the bolt conduit 84 is aft of the seal 86, an intermediate disposition whereat the bolt conduits 84 are aligned with the housing groove 99, and a forwardmost disposition whereat the bolt conduit 84 is forward of the seal 88. When the bolt is in its aftmost disposition, a projectile may be fed to the gun as shown by U.S. Pat. No. 4,244,270 supra. When the bolt is in, or passing through, its intermediate disposition, liquid propellant may be metered, from the pressurized reservoir through the conduits 98 and 84, into the bore enlargement 82 which serves as an ignition antechamber and the remainder of the bore 74 which serves as an inertial conduit or column.

The barrel assembly and the housing define a substantially hollow cylindrical cavity 134 in which are telescopically disposed a substantially hollow cylindrical valve 136 and a substantially hollow cylindrical piston 138.

The valve 136 includes a forward annular portion 140 having an inner wall surface 142 providing an annular gap or passageway 144 adjacent the outer wall surface 146 of the barrel. The annular portion 140 is integral with an intermediate tubular portion 152 having an inner wall surface 154 providing an annular cavity 156 adjacent the outer wall surface 146, and an outer wall surface 158 providing an annular cavity 160 adjacent the inner wall surface 150 of the housing. The intermediate portion 152 is integral with an aft annular portion 162 having an inner wall surface 164 journaled on the outer wall surface 166 of the barrel and substantially sealed thereto, a transverse aft surface 168 a transverse forward surface 170, an inner annular cavity 172, a plurality of longitudinal bores or passageways 174 extending between the surfaces 168 and 170, and a ring seal 176 disposed in an annular groove in the outer wall surface 158. A plurality of longitudinal bores 177 provides passageways between the cavity 156 and the cavity 172 when the valve 136 is aft of its forwardmost position. Two rods 178 have their aft ends respectively fixed to the forward annular portion 140, and pass through bores in the housing. The rods are each biased aftwardly by a respective helical compression spring 310 captured between a cross pin on the rod and a plug in the housing. Each rod may have a respective seal, not shown.

The piston 138 includes a forward annular portion 190 having an inner wall surface 192 journaled on the surface 158 of the valve and an outer wall surface 194 spaced from the surface 150 of the housing. The annular portion 190 is integral with an intermediate tubular portion 196 having an inner surface 192 bearing against the ring seal 76 in the valve, and an outer surface 200 bearing against a ring seal **202*a* and disposed in an annular groove in the inner surface 204 of the housing. An O ring 202*b* backs up the ring seal. The intermediate portion 196 is integral with an aft annular portion 206 having mounted thereon a ring type, foot valve 208 which is normally self biased to journal on and seal against the aftmost portion 166*a* of the outer surface 166 of the barrel. The valve 208 has a cut therein, which permits the diameter of the ring to increase under internal counter-pressure. It will be seen that the effective cross-sectional area of the forward surface 214 of the aft annular portion 206 is less than the effective cross-sectional area of the aft surface 212, providing the piston sleeve 138** with a differential piston action.

The barrel 50, the valve 136 and the piston 138, depending on their mutual positioning, may be considered to define a liquid propellant fill cavity 156, a valve cavity 172, a pumping cavity 218, and a combustion cavity 220. The barrel 50 has a first plurality of radial passageways 226 which serves as passageway between the bumping chamber 218 and the bore 54.

A supply means 251 for supplying liquid propellant under pressure is coupled to a cam controlled valve 252 which is coupled to an inlet in the housing which leads to an annular passageway 254 in the housing, from which a plurality of radial bores 256 lead to and through the forward portion of the surface 150. A radial bore 258 leads through and from the surface 150 aft of the annulus 190 of the piston 138 to a vent. The supply means 251 is also coupled via a cam controlled valve 259 to the conduit 98.

Two rods 270 and 272 have their aft ends respectively fixed to the forward annular portion 190 of the piston 138, and pass through bores with seals in the spacer 149 and the housing. The forward ends of the rods respectively terminate in an enlargement. A drum cam, such as is shown in U.S. Pat. No. 3,763,739, supra, has a helical control track in which rides a cam follower which has an arm which terminates in a rod follower. The rods are free to move forwardly free of the follower, but are controlled in their movement aftwardly by the cam track via the followers. The cam track is also able to pull the rods forwardly via the followers.

The barrel 50 has an enlarged portion 300 with an outer surface 159 with a seal 302 which rides on and serves to seal against the inner surface 154 of the valve 136. A plurality of substantially longitudinal bores 177 are disposed in an annular row through the enlargement to serve as passageways from the fill annular cavity 156 to the valve cavity 172. The plurality of longitudinal bores 174 serve as passageways from the valve cavity 172 to the pumping cavity 218. When the pressure difference between the pumping cavity 218 and combustion chamber 220 exceeds the natural bias of the foot valve 208, it forces the valve 208 open to provide a gap between the outer surface 166*a* of the barrel and the valve which serves as a passageway from the pumping cavity 218 to the combustion chamber 220.

A belleville washer 306 is seated in the valve cavity 172 on the barrel adjacent the bores 177 and retained by a retaining ring 308. The washer is normally conical in shape and permits the flow of liquid propellant from the fill cavity 156, through the passageways 177, around the washer 306, through the valve cavity 172, and through the passageways 174 into the pumping cavity 218. Prior to firing, the differential valve 136 is held in the position shown in the upper portion of FIG. 3 by means of external compression springs 310 coupled to the rods 178, so that the surface 166 of the valve head 162 closes the radial bores 226 and precludes the flow of liquid propellant from the pumping cavity 218 into these bores. At the beginning of firing, the liquid pressure in the pumping cavity 218 will rise and be communicated to the valve cavity 172. This increase in pressure on the aft face of the washer 306 over the pressure on the forward face of washer will force the washer flat against its inherent spring force to close the passageways 177, to isolate the fill cavity 156 and its anterior system from the ballistic fluid pressures generated during the firing. During firing, because the forward face 170 of the valve head has less transverse area than the aft face 168, the differential force generated thereby will force the valve 136 forward, against the bias of the springs 310, to reduce the volume of the valve cavity 172 to substantially zero and to uncover the bores 226.

In the embodiment here shown, firing is initiated by passing an electrical current, from a cam controlled current source 37, between the exposed end of the electrode 78 to the inner wall of the bore enlargement 82 to generate and pass hot gas under high pressure through the bore 74 and through the vents 76 into the combustion cavity 120. This gas under pressure will act on the aft face 212 of the piston head 206 to force the piston forwardly, increasing the pressure in the pumping cavity 218 to open the foot valve 208 thereby providing an annular gap. Liquid propellant is forced from the pumping cavity 218 through this annular gap into the combustion cavity 220 and is ignited by the hot gas therein. Because the forward face 214 of the piston head has less transverse area than the aft face 212, the differential force generated will force the piston forwardly continuing the flow of liquid propellant through the annular gap. At a predetermined gas pressure in the combustion chamber, the projectile band 62 will be engraved by the rifling and the projectile will ride forwardly into the gun barrel bore to uncover the bores 226. Since the valve head 162 has already uncovered these bores, liquid propellant is now free to pass from the pumping cavity 218 through these bores into the aft end of the gun barrel bore to provide an annulus of liquid propellant in the gun barrel bore whose inner face is continually being burned and whose outer face is being continually replenished.

In the event of a misfire, both the differntial valve 136 and the belleville washer valve will remain in their initial, open dispositions, to permit the liquid propellant in the pumping cavity 218 to be returned to the supply system 251 by the process of moving the differential piston forwardly via the rods 170 and 172.

What is claimed is:

1. A liquid propellant gun comprising:
a main combustion chamber;
an ignition antechamber having a first cross-sectional area,
two spaced apart electrodes, and
an inlet port for liquid propellant: and
a first conduit having a length over diameter ratio greater than one and a second cross-sectional area which is less than said first cross-sectional area,
an inlet which opens into said ignition antechamber, and
an outlet which opens into said main combustion chamber.

2. A gun according to claim 1 wherein:
said conduit outlet includes an orifice having a third cross-sectional area which is less than said second cross-sectional area.

3. A gun according to claim 1, further including:
a source of liquid propellant under pressure;
a second conduit means including a valve means and coupling said source of liquid propellant to said inlet port of said antechamber;
control means coupled to said valve means for causing said source to provide a predetermined quantity of liquid propellant into said antechamber and said first conduit.

4. A gun according to claim 1, further including:
a housing;
a gun barrel bore;
an annular valve sleeve coaxial with said gun barrel bore;
an annular differential area piston sleeve coaxial with said gun barrel bore;
said valve sleeve and said piston sleeve defining a pumping cavity;
said piston sleeve and said housing defining said combustion cavity.

5. A gun according to claim 1, further including:
a housing having breech;
a gun bolt removably disposed within said breech;
said ignition antechamber and said first conduit being disposed within said bolt.

6. A gun according to claim 5, further including:
a cam controlling the disposition of said gun bolt;
a cam controlling the provision of electrical current to said two electrodes.

* * * * *